US005788548A

United States Patent [19]

Hjaltason

[11] Patent Number: 5,788,548

[45] Date of Patent: Aug. 4, 1998

[54] WATER-SKIS

[76] Inventor: Thor Daniel Hjaltason, 2775 Wooded Glen Ct., Indianapolis, Ind. 46268

[21] Appl. No.: 737,023

[22] PCT Filed: Mar. 1, 1996

[86] PCT No.: PCT/GB96/00471

§ 371 Date: Feb. 25, 1997

§ 102(e) Date: Feb. 25, 1997

[87] PCT Pub. No.: WO96/27524

PCT Pub. Date: Sep. 12, 1996

[30] Foreign Application Priority Data

Mar. 3, 1995 [GB] United Kingdom ..... 9504268

[51] Int. Cl.[6] ..... B63B 1/00

[52] U.S. Cl. ..... 441/68; 114/253

[58] Field of Search ..... 441/68, 69, 73, 441/75; 114/253; 280/609, 601, 606, 14.2, 14.3, 24

[56] References Cited

U.S. PATENT DOCUMENTS 3,216,031 11/1965 Ingold, Jr. ..... 441/68

FOREIGN PATENT DOCUMENTS 238074 1/1965 Austria ..... 280/609

2704858 8/1978 Germany ..... 280/609

*Primary Examiner*—Jesus D. Sotelo

*Attorney, Agent, or Firm*—St. Onge Steward Johnston & Reens LLC

[57] ABSTRACT

A monoski (1) having an open-ended longitudinal slot (5) through the thickness of the ski which extends rearwardly along the ski from the toe (6). In use, the tow line in (2) the starting position is located in the slot (5), thereby restricting movement of the ski from side and making it easier for a skier to maintain balance whilst being pulled from a partially submerged starting position to the skiing position.

25 Claims, 7 Drawing Sheets

WATER-SKIS

The present invention relates to an improvement in water-skis, specifically to monoskis, that is water-skis on which a person can stand with both feet.

On a monoski, as compared to a pair of skis, it is difficult to maintain balance when being pulled from a floating, starting position, in which the skier and ski are partially submerged, to the skiing position, in which the ski rides on the water surface. This is because of the positioning of the feet on the ski. By requiring the feet to be located one behind the other, the skier cannot attain a balanced stance, in which the feet can be spread apart, in the manner possible when using two skis. When using two skis it is far easier for a skier to get up from the water to the skiing position as compared to when using a monoski since the skier can spread his/her feet to achieve a good balance. Moreover, when using two skis the tow line which pulls the skier can in the starting position be placed between the skis thus further assisting the skier in attaining a balanced position during the initial period when being pulled from the starting position to the skiing position.

FIG. 1 shows in perspective view the arrangement of the front part of a conventional monoski 51 and tow line 52 in the partially submerged starting position. When using a conventional monoski 51, the tow line 52 has to be placed on one side of the front part of the ski 51 which extends above the waterline when in the starting position, and this makes it more difficult to maintain balance since the pulling force $F_1$ on the ski 51 acts in a different direction to that of the pulling force $F_2$ from the tow line 52. When the skier is pulled from the starting position, the pulling force $F_2$ from the tow line 52 tends to pull the hands and upper body of the skier in one direction, i.e. to one side, whilst the ski 51 is pushed by the skier's feet in an opposed direction. This causes considerable problems for beginners and intermediate skiers, and can even give difficulty to proficient skiers. The difficulties in assuming the skiing position on a monoski are well known and consequently there is a general belief that skiing on a monoski is actually more difficult than it really is.

Developments in water-skis have usually related to the shape, the floating characteristics or the carving (i.e. cornering) ability of the skis. Indeed, modern water-skis are available in many varied shapes and sizes, and are offered with numerous lower surface designs for providing different floating characteristics. Modern water-skis are not primarily designed for the purpose of enabling or assisting beginners or intermediate skiers to get from the starting position to the skiing position.

The best and often the only way to practice monoskiing is to assume the starting position with two skis. Then, after reaching the skiing position the skier discards one ski and puts his/her free foot in a second shoe, usually a rear shoe, provided on the other ski. Nevertheless, even using this technique unskilled skiers regularly fall and have to repeat the procedure. This requires the dropped ski to be found and brought back to the skier, during which time the skier will have to wait several minutes in often cold water which rapidly becomes a tiring exercise. Moreover, there is a chance of losing the dropped ski completely.

It is an aim of the present invention to provide a monoski which allows a skier to maintain balance more readily whilst being pulled from a partially submerged starting position to the skiing position, and thereby makes it easier and safer for a skier to get from the partially submerged starting position to the skiing position.

Accordingly, the present invention provides a monoski having an open-ended longitudinal slot through the thickness of the ski which extends rearwardly along the ski from the toe. In use, the tow line in the starting position is located in the slot, thereby restricting the movement of the ski from side to side and making it easier for a skier to maintain balance whilst being pulled from a partially submerged starting position to the skiing position because the pulling force exerted by the tow line can be substantially aligned with the pulling force on the monoski. The present invention also provides such a monoski in combination with a tow line.

preferred embodiments of the present invention will now be described hereinbelow by way of example only with reference to the accompanying drawings, in which.

Figure 1:
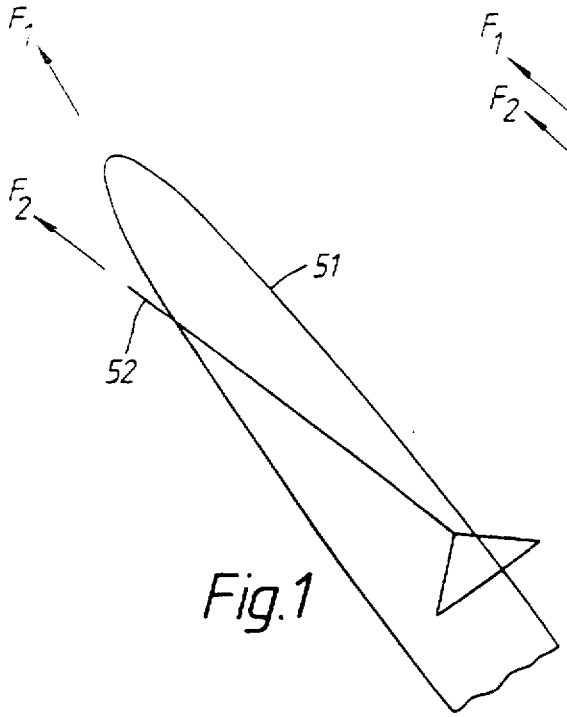
FIG. 1 shows a perspective view of the front part of a conventional monoski and tow line, and the pulling forces associated therewith in the partially submerged starting position.
Figure 4:
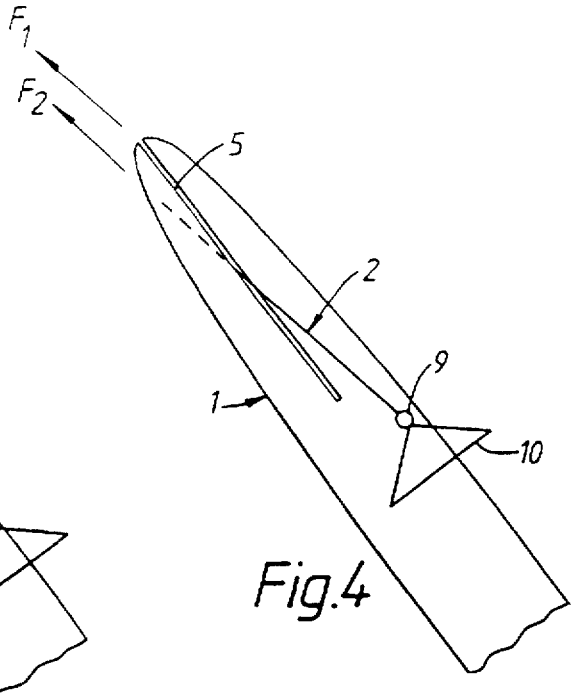
Figure 2:
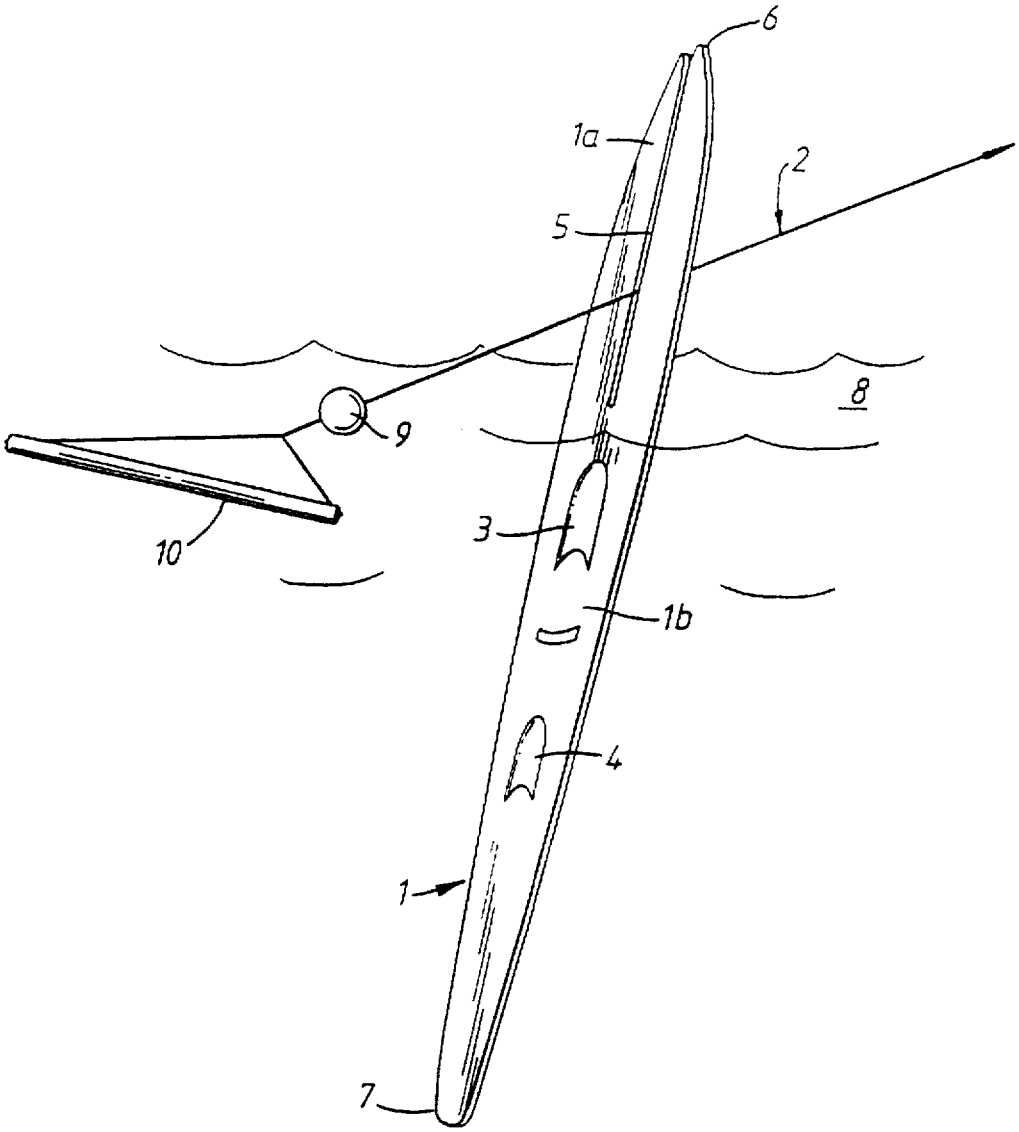
FIG. 2 shows a perspective view of a monoski and tow line in accordance with a first embodiment of the present invention, shown in the partially submerged starting position.
Figure 5A:
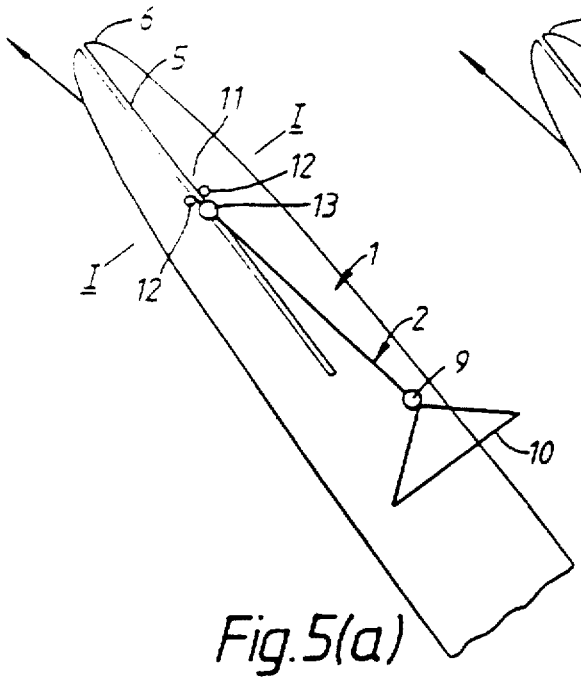
Figure 5B:
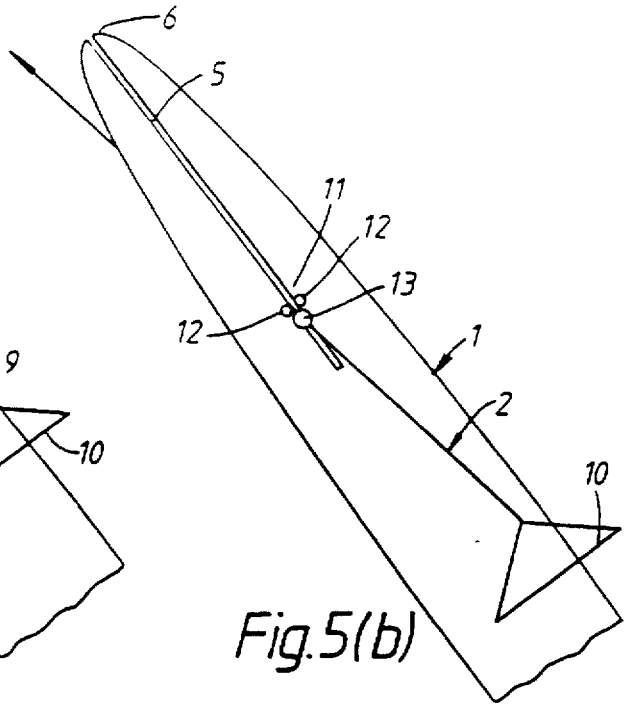
Figure 6:
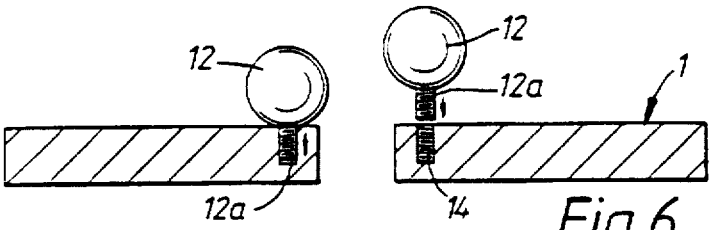
Figure 7:
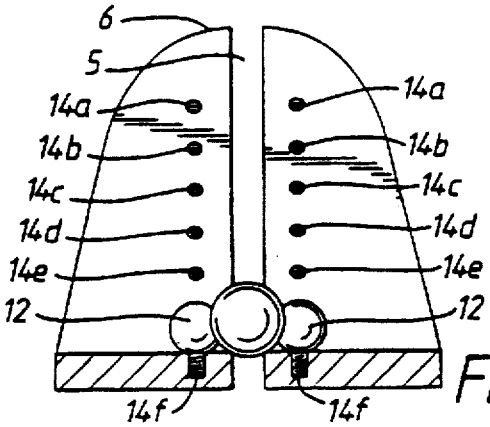
Figure 8A:
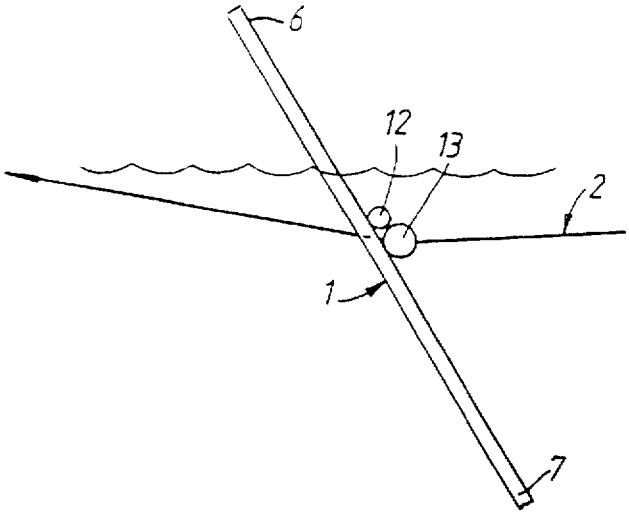
Figure 8B:
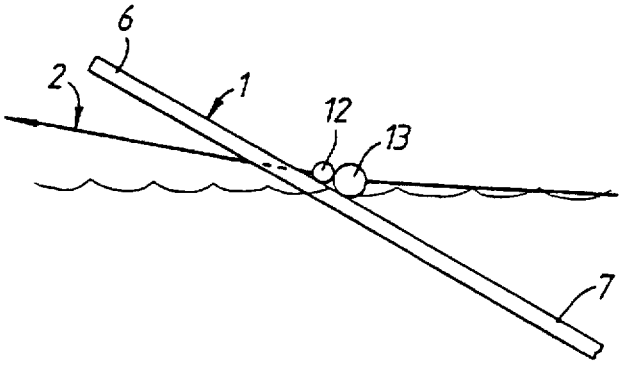
Figure 8C:
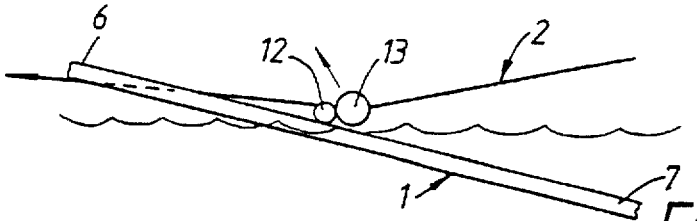
Figure 8D:
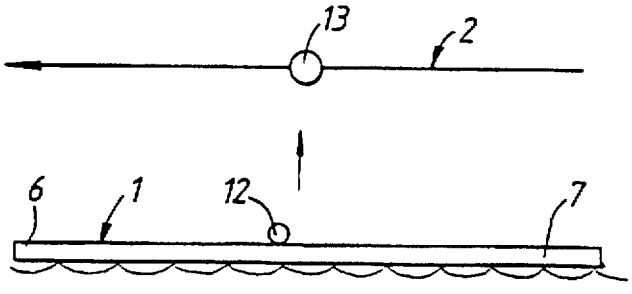
Figure 9A:
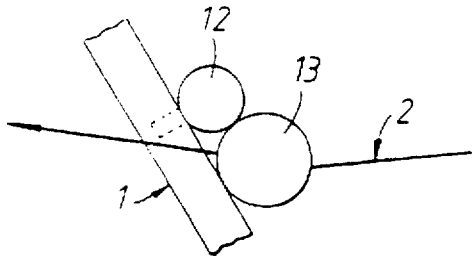
Figure 9B:
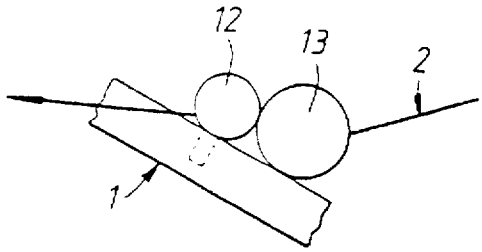
Figure 9C:
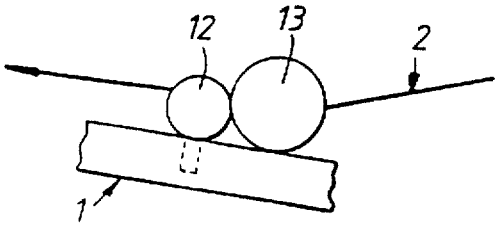
Figure 9D:
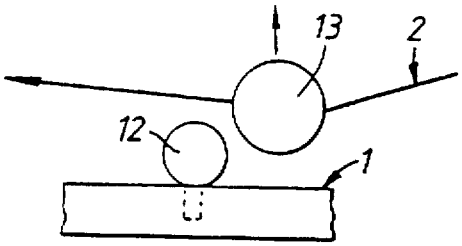
Figure 10:
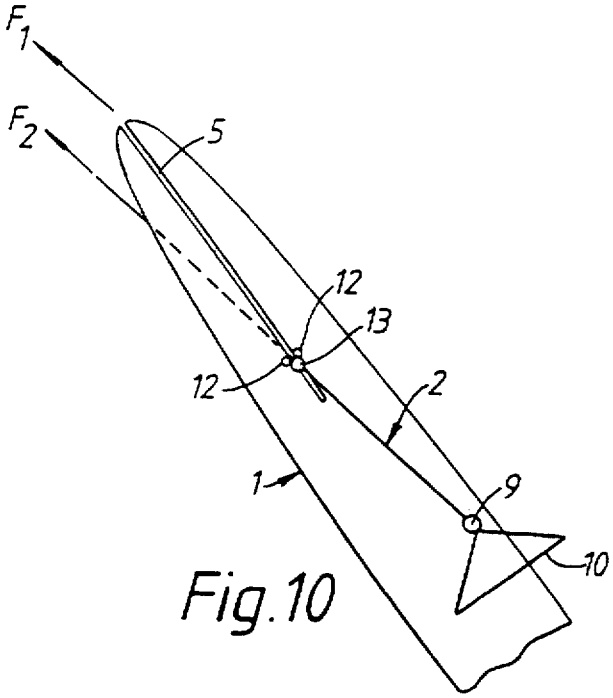
Figure 11:
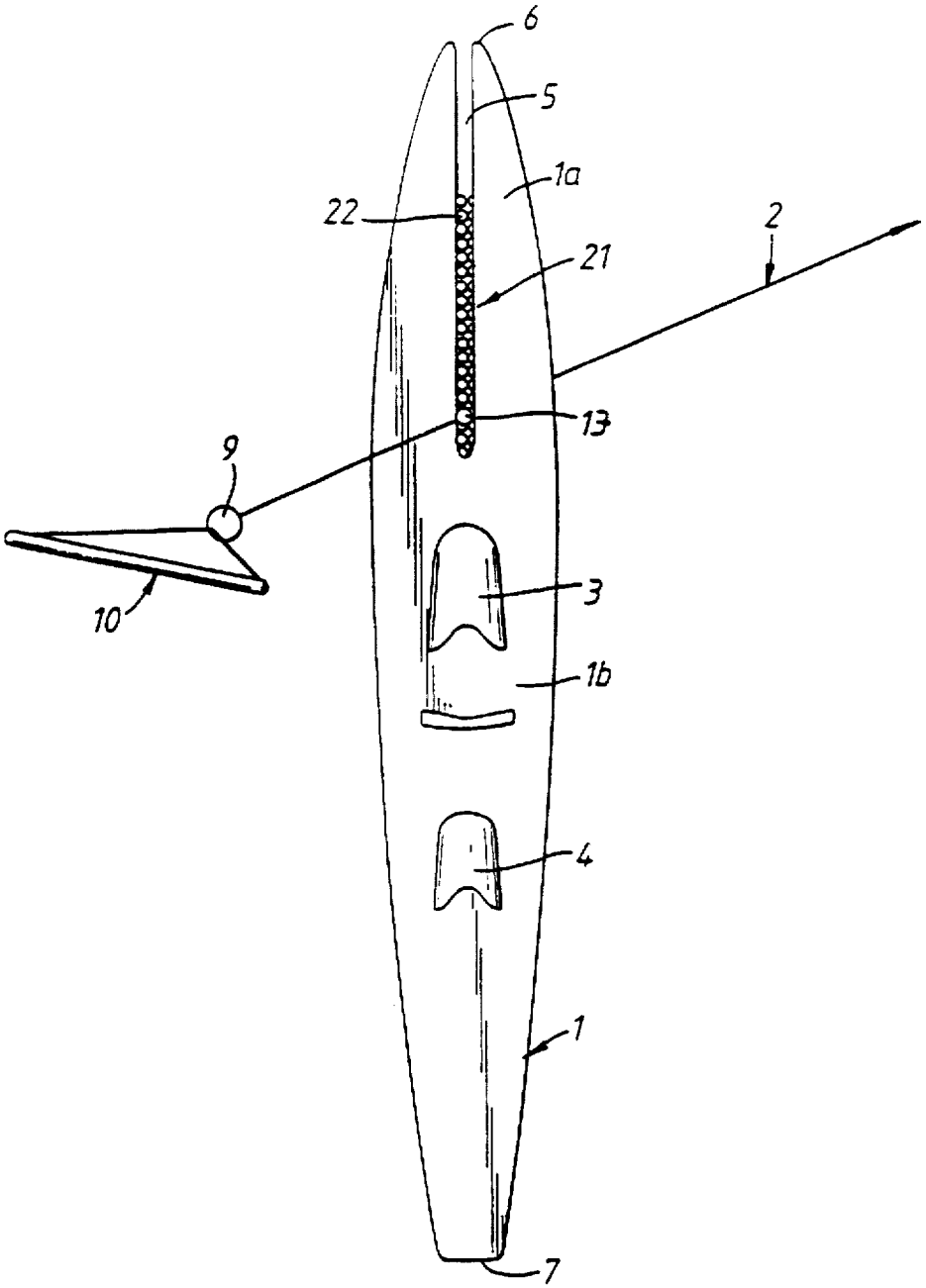
Figure 12:
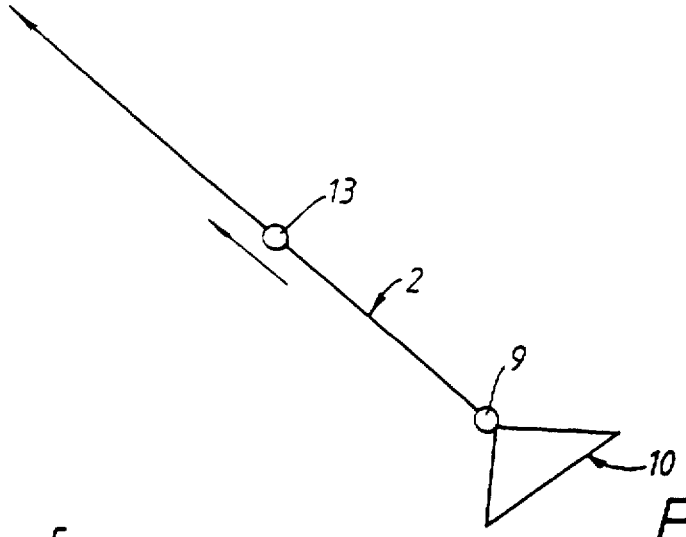
Figure 13:
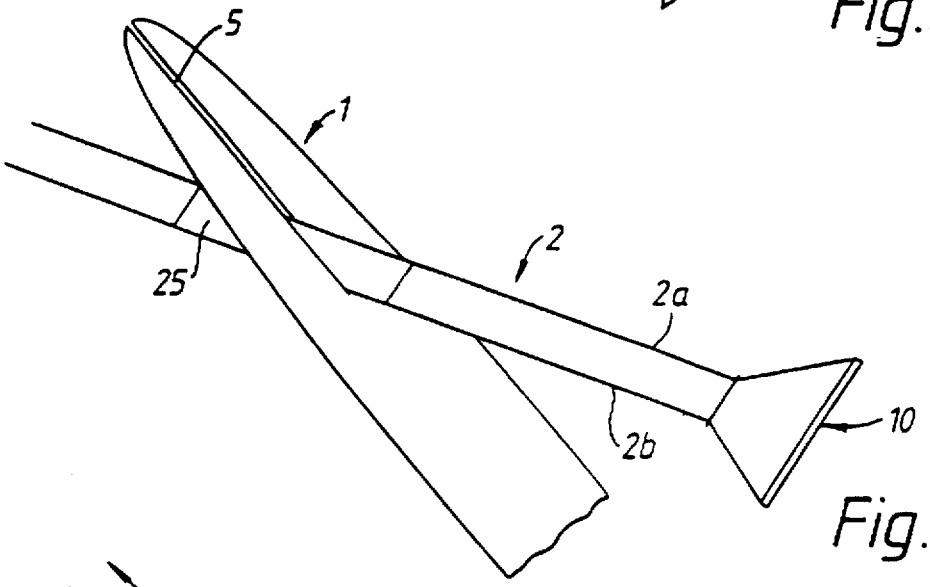
Figure 14:
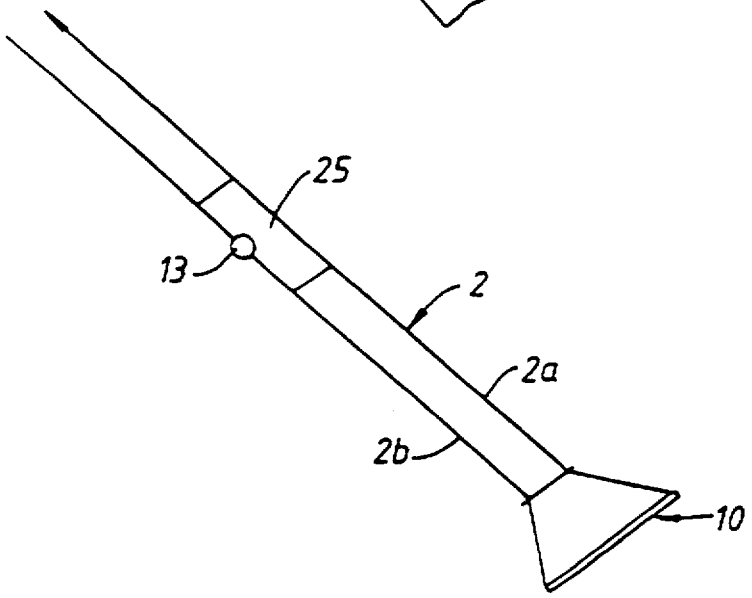

FIGS. 3(*a*) to 3(*e*) show enlarged sectional views of several alternative slot designs for use in the ski of FIG. 2;

FIG. 4 shows a perspective view of the front part of a conventional monoski and tow line, and the pulling forces associated therewith in the partially submerged starting position;

FIGS. 5(*a*) and 5(*b*) illustrate perspective views of the front part of a ski and tow line in accordance with a second embodiment of the present invention, shown in the partially submerged starting position;

FIG. 6 shows a cross-sectional view along line I—I in FIG. 5(*a*), with one fixing member withdrawn;

FIG. 7 shows an enlarged perspective view of the front part of the ski of FIGS. 5(*a*) and 5(*b*);

FIGS. 8(*a*) to 8(*d*) show the interrelationship of the ski and tow line of FIGS. 5(*a*) and 5(*b*) during the transition from the partially submerged starting position to the skiing position;

FIGS. 9(*a*) to 9(*d*) illustrate in enlarged cross-section the operation of the catch member on the tow line and the fixing members on the ski of FIGS. 5(*a*) and 5(*b*) during the transition from the partially submerged starting position to the skiing position;

FIG. 10 illustrates a perspective view of the front part of the monoski and tow line of FIGS. 5 to 9, and the pulling forces associated therewith in the partially submerged starting position;

FIG. 11 illustrates a plan view of a monoski and a tow line in accordance with a third embodiment of the present invention;

FIG. 12 illustrates a tow line having an adjustable catch member mounted thereto; and FIGS. 13 and 14 illustrate a twin-line tow line having a bracket member fastened therebetween which is utilisable with the skis in accordance with the present invention.

Figure 3A:
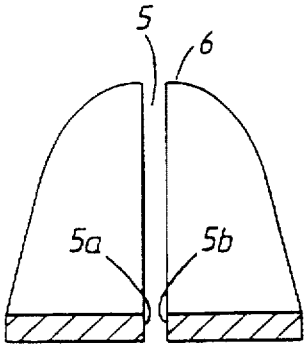
Figure 3B:
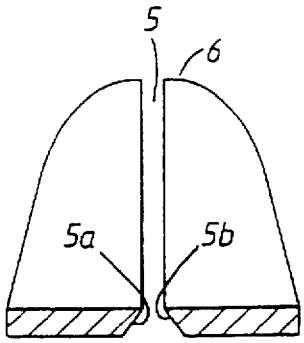
Figure 3C:
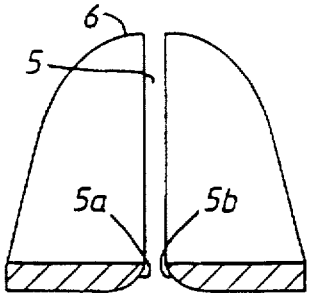
Figure 3D:
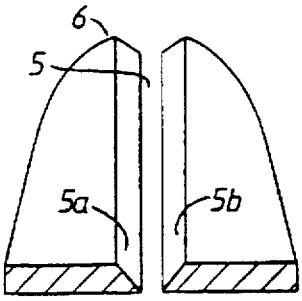
Figure 3E:
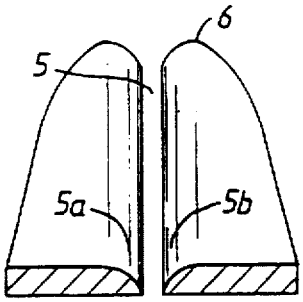

FIG. 2 illustrates a monoski 1 and tow line 2 in accordance with a first embodiment of the present invention. In FIG. 2, the ski 1 and tow line 2 are shown in the starting position, in which position the ski 1 is partially submerged. The ski 1 has in its Front part 1a an open-ended slot 5 through the thickness of the ski 1. The slot 5 extends rearwardly along a central longitudinal line from the frontmost part of the ski 1, namely the toe 6, towards a central part 1*b* of the ski 1. The central part 1*b* of the ski 1 is provided on its upper surface with conventional front and rear shoes 3,4 in which the feet of a skier are located in use. The slot 5 is or narrow section and in plan section may be of elongated "U" or "VI" shape. In cross-section the longitudinal walls 5a, 5b of the slot 5 may extend perpendicular to the surface of the ski 1 (see FIG. 3(a)), or may be formed so as to have a greater width at one of the lower surface (see FIGS. 3(b) and 3(c)) or upper surface (see FIGS. 3(d) and 3(e)) of the ski 1. FIGS. 3(b) and 3(c) illustrate slots having flat, inclined longitudinal walls 5a, 5b and FIGS. 3(d) and 3(e) illustrate slots having rounded, convex longitudinal walls 5a, 5b. The slot D is typically approximately 40 to 50 cm long. The slot 5 may be formed during the production of the ski 1, for example during injection moulding, or may be cut into a finished ski, for example by sawing, laser cutting, routing or water cutting. The slot 5 may also be provided with sealing means for preventing, in use, water from passing through the slot 5.

In use, in the starting position, the ski 1 extends substantially vertically, with the toe 6 of the ski 1 extending about 20 to 40 cm above the waterline. In this position the tow line 2 extends through the slot 5. When the tow line 2 is taut, drifting of the ski 1 from side to side is restricted, thereby effectively fixing the position of the skier and ski 1 in relation to the tow line 2. In this embodiment, as illustrated in FIG. 3, the pulling force $F_1$ on the ski 1 and the pulling force $F_2$ from the tow line 2 are parallel. This arrangement effectively maintains the skier, ski 1 and tow line 2 in an imaginary plane, and thus enables the skier more readily to maintain balance and the same course as the ski 1 whilst being initially pulled during the first critical period from the starting position to the skiing position. The slot 5 is of sufficient width to allow free movement of the tow line 2 therein and release therefrom.

Where a ski 1 in accordance with the present invention is used, the tow line 2 is preferably provided below the handle 10 with a stop member 9, whose dimension is greater than the width of the slot 5, so as to prevent the handle 10 and associated line from being drawn into and caught in the slot 5 which could result in injury to the skier, e.g. a twisted ankle or other injuries to the feet. The stop member 9 is preferably spheroidal and can be formed by the injection moulding of plastics or otherwise from a rubber-type material. The stop member 9 may be fixed permanently to the tow line 2 in one position, or may be adjustably attached to the tow line 2 such that it can be moved along the tow line 2 and fixed thereto at any desired position along its length. Typically, if the skier loses grip on the handle 1o, the tow line 2 will pass through the slot 5 until the stop member 9 reaches the upper surface of the ski 1. At that time, the stop member 9 will then ride over the surface of the ski 1 towards the toe 6 as the tow line 2 is drawn further, until the tow line 2 eventually passes from the slot 5. The force with which the stop member 9 hits the front part of the ski 1, will not result in backlash from the tail 7 as when the tow line 2 is located in the slot 5 the tail 7 is submerged and thereby its motion is resisted by the body of water.

FIGS. 5(a) and 5(b) illustrate the front Dart of a ski 1 and tow line 2 in accordance with a second embodiment of the present invention. In this embodiment the ski 1 is of similar construction to that of the first described embodiment, however, the slot 5 is additionally provided with a pair of fixing members 12. The fixing members 12 are fixed to the upper surface of the ski 1 on opposed sides of the slot 5 and are adapted to receive and hold a catch member 13 provided on the tow line 2 during the initial critical period when the skier is being pulled from the partially submerged starting position to the skiing position. FIGS. 5(a) and 5(b) respectively illustrate arrangements where the fixing members 12 are located in relatively forward and rearward positions along the length of the slot 5.

The fixing members 12 are attached to the ski 1 by respective threaded stud parts 12a as shown in FIG. 6. The stud parts 12a are received in threaded openings 14 provided in the ski 1. FIG. 6 illustrates the manner in which the fixing members 12 are attached to the ski 1. In FIG. 6 the stud part 12a of the right fixing member 12 is shown in a position withdrawn from the opening 14. In use, the stud part 12a is screwed into the opening 14, and located on the ski 1 in the manner of the left fixing member 12. In this embodiment, as shown in FIG. 7, a plurality of spaced pairs of threaded openings 14a–14e are provided along the length of the slot 5 so as to allow the fixing members 12 to be selectively positioned along the length of the slot 5. In this way, use of the ski 1 by many skiers of different size is possible by re-positioning the fixing members 12.

In use, in the starting position as shown in FIGS. 8 (a) and 9 (a), the catch member 13 is engaged behind the fixing members 12. Thus, when a pulling force is applied to the tow line 2, the pulling force is resisted by the fixing members 12, thereby drawing the ski 1 without applying any load to the skier. In this embodiment, as shown in FIG. 10, the pulling force $F_2$ on the ski 1 is parallel to the pulling force $F_2$ from the tow line 2. As a pulling force is applied the ski 1 levels off, i.e. the toe 6 of the ski moves nearer the surface of the water, in the manner shown in FIGS. 8 (b), 9 (b) and 8 (c), 9(c). This continues until the angle between the ski 1 and the tow line 2 reaches a critical angle, at which time the catch member 13 is automatically released from the fixing members 12 as shown in FIGS. 8(d) and 9(d) and the skier assumes the skiing position.

FIG. 11 illustrates a ski 1 in accordance with a third embodiment of the present invention. In this embodiment the ski 1 is of similar construction to that of the first described embodiment, however, the slot 5 is additionally provided with a fixing means 21 which is adapted to receive and hold the tow line 2 during the initial critical period when the skier is being pulled from the partially submerged starting position to the skiing position. In this embodiment the fixing means 21 comprises a body having a plurality of longitudinally spaced pairs of projections 22, each pair of projections 22 being adapted to receive a catch member 13 fixed to the tow line 2. The catch member 13 is attached to the tow line 2 at a fixed distance from the handle 10, and is located at a selected one of said pairs of projections 22 according to the height of the skier so as to achieve the correct posture in the starting position. The catch member 13 is preferably adjacent the slot 5 and is preferably formed by injection moulding. The fixing means 21 can be formed as an integral part of the ski 1 or can be a separately firmed component which is subsequently fitted to the ski 1.

In use, when the catch member 13 is engaged with a respective pair of projections 22 and a pulling force is applied to the tow line 2, the pulling force is resisted by the fixing means 21, thereby drawing the ski 1 forwards. The fixing means 21 is adapted to release automatically the catch member 13 when the angle between the ski 1 and the tow line 2 reaches a critical angle, tropically that angle achieved when the ski 1 rides on the surface of the water, in essentially the manner of the second embodiment of the present invention as described in relation to FIGS. 8(a–d) and 9(a–d).

It will be understood that the fixing means 21 may be of any configuration which receives and holds the member 13 attached to the tow line 2 until a critical angle is reached. In this embodiment the fixing means 21 comprises a plurality of projections 22 which provide for the attachment of the tow line 2 at various positions along the length of the slot 5, thereby allowing the use of the same ski 1 by skiers of different size without modification. However, the fixing means 21 alternatively may comprise a single attachment part, for example one pair of projections 22, which is fixedly mounted to the ski 1, and the catch member 13 may be adjustably attached to the tow line 2 such that it can be moved along the tow line 2 and fixed thereto at any position along its length. FIG. 12 illustrates a tow line 2 having such a catch member 13.

FIG. 13 illustrates a modified tow line 2 which can be used in conjunction with any of the above-described embodiments of the present invention. The tow line 2 comprises first and second lines 2*a*, 2*b* having a bracket member 25 fastened therebetween in that position where the tow line 2 is located in the slot 5 in the starting position. The bracket member 25 provides increased stabilization and support. The bracket member 25 may be made from flexible or rigid plastic sheet, or a rubber-based material. The bracket member 25 may also be provided with a catch member 13 as illustrated in FIG. 14.

I claim:

1. A water-monoski having a front shoe, a rear shoe and an open-ended longitudinal slot through the thickness of the ski which extends rearwardly along the ski from the toe.

2. A ski as defined in claim 1, wherein the slot extends along a central longitudinal line of the ski.

3. A ski as defined in claim 1, wherein the slot is provided with a seal for preventing, in use, water from passing through the slot.

4. A ski as defined in claim 1, wherein the slot extends a distance of from 40 to 50 cm from the toe of the ski.

5. A ski as defined in claim 1, further comprising a fixing device for receiving and engaging a catch member mounted on a tow line.

6. A ski as defined in claim 5, wherein the fixing device comprises a plurality of pairs of projections located along the length of the slot, each or the projections of a respective pair being located on opposed sides of the slot.

7. A ski as defined in claim 6, wherein said plurality of pairs of projections are integrally formed with the ski.

8. A ski as defined in claim 6, wherein said plurality of pairs of projections are provided in a body which is mounted on the ski.

9. A ski as defined in claim 5, wherein the fixing device comprises first and second fixing members which are provided on the upper surface of the ski on opposed sides of the slot.

10. A ski as defined in claim 9, wherein the first and second fixing members are permanently fixed to the ski in one position.

11. A ski as defined in claim 9, wherein the first and second fixing members can be selectively positioned along the length of the slot.

12. A ski as defined in claim 9, wherein each fixing member includes a stud part which is located in a respective opening formed in the upper surface of the ski.

13. A ski as defined in claim 12, wherein the stud parts and openings are threaded.

14. A ski as defined in claim 12, further comprising a plurality of pairs of openings in spaced relation along the length of the slot, the stud parts of the fixing members being selectively locatable in one of said pairs of openings.

15. A ski as defined in claim 1 in combination with a tow line.

16. A ski and tow line as defined in claim 15, wherein the tow line has a stop member mounted thereto which is of greater dimension than width of the slot.

17. A ski and tow line as defined in claim 16, wherein the stop member is spheroidal.

18. A ski and tow line as defined in claim 16, wherein the stop member is permanently fixed to the tow line in one position.

19. A ski and tow line as defined in claim 16, wherein the stop member can be moved along the length of the tow line and selectively fixed thereto in any position.

20. A ski and tow line as defined in claim 15, wherein the tow line has a catch member which is permanently mounted to the tow line in one position.

21. A. A ski and tow line as defined in claim 20, wherein the fixing is adapted to receive the catch member such that the catch member is released therefrom when the angle between the ski and the tow line reaches a critical angle.

22. A ski and tow line as defined in claim 20, wherein the catch member is spheroidal.

23. A ski and tow line as defined in claim 15, wherein the tow line has a catch member which can be moved along the length of the tow line and selectively fixed thereto in any position.

24. A ski and tow line as defined in claim 27, wherein the catch member is spheroidal.

25. A ski and tow line as defined in claim 27, wherein the fixing device is adapted to receive the catch member such that the catch member is released therefrom when the angle between the ski and the tow line reaches a critical angle.

* * * * *

UNITED STATES PATENT AND TRADEMARK OFFICE

CERTIFICATE OF CORRECTION

PATENT NO. : 5,788,548

DATED : August 4, 1998

INVENTOR(S) : Thor Daniel Hjaltason

It is certified that error appears in the above-identified patent and that said Letters Patent is hereby corrected as shown below:

At Column 2, line 13, "preferred" should be replaced with --Preferred--.

At Column 2, line 63, "Front" should be replaced with --front--.

At Column 3, line 3, "or" should be replaced with --of--.

At Column 3, line 4, "VI" should be replaced with --V--.

At Column 3, line 12, "slot D" should be replaced with --slot 5--.

At Column 3, line 48, "1o" should be replaced with --10--.

At Column 3, line 58, "Dart" should be replaced with --part--.

At Column 4, line 26, "$F_2$" should be replaced with --$F_1$--. (first occurrence)

At Column 4, line 61, "tropically" should be replaced with --typically--.

At Column 6, line 34, Claim 21, the word --device-- should be inserted immediately after the word "fixing".

Signed and Sealed this

Twentieth Day of October, 1998

*Attest:*

*Attesting Officer*

BRUCE LEHMAN

*Commissioner of Patents and Trademarks*